US008134349B2

(12) United States Patent
Shiga et al.

(10) Patent No.: US 8,134,349 B2
(45) Date of Patent: Mar. 13, 2012

(54) POWER SUPPLY CIRCUIT THAT OUTPUTS A VOLTAGE STEPPED DOWN FROM A POWER SUPPLY VOLTAGE

(75) Inventors: Hidehiro Shiga, Kamakura (JP); Shinichiro Shiratake, Yokohama (JP); Daisaburo Takashima, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 425 days.

(21) Appl. No.: 12/404,438

(22) Filed: Mar. 16, 2009

(65) Prior Publication Data

US 2009/0256542 A1 Oct. 15, 2009

(30) Foreign Application Priority Data

Apr. 11, 2008 (JP) ..... 2008-103713

(51) Int. Cl.
*G05F 1/613* (2006.01)

(52) U.S. Cl. ..... 323/224; 323/225; 323/226; 323/270

(58) Field of Classification Search ..... 323/224, 323/225, 226, 270, 293, 273
See application file for complete search history.

(56) References Cited

U.S. PATENT DOCUMENTS

| | | | | |
|---|---|---|---|---|
| 4,524,317 | A * | 6/1985 | Millard | 323/224 |
| 6,292,424 | B1 | 9/2001 | Ohsawa | |
| 6,351,179 | B1 | 2/2002 | Ikehashi et al. | |
| 6,696,822 | B2 * | 2/2004 | Takabayashi | 323/224 |
| 6,707,280 | B1 * | 3/2004 | Liu et al. | 323/224 |
| 7,589,507 | B2 * | 9/2009 | Mandal | 323/273 |
| 7,973,518 | B2 * | 7/2011 | Shor et al. | 323/224 |

FOREIGN PATENT DOCUMENTS

| | | |
|---|---|---|
| JP | 8-195081 | 7/1996 |
| JP | 2000-58761 | 2/2000 |

* cited by examiner

*Primary Examiner* — Jeffrey Sterrett
(74) *Attorney, Agent, or Firm* — Oblon, Spivak, McClelland, Maier & Neustadt, L.L.P.

(57) ABSTRACT

A power supply circuit has a constant voltage circuit, a first MOS transistor, a second MOS transistor, a third MOS transistor, a first voltage dividing circuit that outputs a first divided voltage obtained by dividing the voltage of the output terminal by a first voltage dividing ratio, and a first differential amplifier circuit which is fed with a reference voltage and the first divided voltage and has an output connected to a gate of the second MOS transistor. The first differential amplifier circuit outputs a signal to turn on the second MOS transistor when the first divided voltage is higher than the reference voltage, and the first differential amplifier circuit outputs a signal to turn off the second MOS transistor when the first divided voltage is lower than the reference voltage.

15 Claims, 5 Drawing Sheets

POWER SUPPLY CIRCUIT THAT OUTPUTS A VOLTAGE STEPPED DOWN FROM A POWER SUPPLY VOLTAGE

CROSS-REFERENCE TO RELATED APPLICATION

This application is based upon and claims the benefit of priority from the prior Japanese Patent Application No. 2008-103713, filed on Apr. 11, 2008, the entire contents of which are incorporated herein by reference.

BACKGROUND OF THE INVENTION

1. Field of the Invention

The present invention relates to, for example, a power supply circuit used for a semiconductor memory such as a flash memory.

2. Background Art

Power supply circuits used for semiconductor memories of the prior art include, for example, a feedback type with a P-channel MOS transistor and a source follower type with an N-channel MOS transistor (for example, see Japanese Patent Laid-Open No. 8-195081 and Japanese Patent Laid-Open No. 2000-58761).

In a power supply circuit of the source follower type with an N-channel MOS transistor of the prior art, a desired voltage is obtained by applying a constant voltage to the gate electrode of a step-down transistor having a large gate width (e.g., on the order of meters).

In this configuration, however, the subthreshold current of the step-down transistor may raise the output voltage of the power supply circuit.

Thus in order to avoid an increase in output voltage, a transistor (bleeder) for drawing a charge by passing a constant current is provided.

The bleeder is necessary when the circuit of the next stage (a circuit using the output voltage as power) has low current consumption.

However, the bleeder is essentially unnecessary when the current consumption of the circuit of the next stage is not lower than the subthreshold current of the step-down transistor. In this case, excessive current is passed through the circuit.

On the other hand, a power supply circuit of the feedback type with a P-channel MOS transistor of the prior art includes two feedback loops using a voltage obtained by directly dividing an output voltage.

The power supply circuit obtains a desired output voltage by controlling the gate potentials of two driving transistors through the two feedback loops.

However, since the power supply circuit includes the two feedback loops requiring quick response, the power supply circuit has to be designed in consideration of problems such as the oscillation of the circuit.

SUMMARY OF THE INVENTION

According to one aspect of the present invention, there is provided: a power supply circuit that outputs a voltage stepped down from a power supply voltage, comprising:

a constant voltage circuit that outputs a constant voltage;

a first MOS transistor having one end connected to ground and a gate fed with a fixed voltage to enable passage of a constant current;

a second MOS transistor connected between an other end of the first MOS transistor and a power supply;

a third MOS transistor which is connected in series with the second MOS transistor between the other end of the first MOS transistor and the power supply and has a gate connected to an output of the constant voltage circuit;

an output terminal connected between the second MOS transistor and the third MOS transistor to output the output voltage stepped down from the power supply voltage;

a first voltage dividing circuit that outputs a first divided voltage obtained by dividing the voltage of the output terminal by a first voltage dividing ratio; and a first differential amplifier circuit which is fed with a reference voltage and the first divided voltage and has an output connected to a gate of the second MOS transistor, wherein the first differential amplifier circuit outputs a signal to turn on the second MOS transistor when the first divided voltage is higher than the reference voltage, and the first differential amplifier circuit outputs a signal to turn off the second MOS transistor when the first divided voltage is lower than the reference voltage.

According to the other aspect of the present invention, there is provided: a power supply circuit that outputs a voltage stepped down from a power supply voltage, comprising:

an output terminal that outputs the output voltage stepped down from the power supply voltage;

a first constant voltage circuit that outputs a first constant voltage;

a second constant voltage circuit that outputs a second constant voltage;

a first MOS transistor having one end connected to ground and a gate fed with a fixed voltage to enable passage of a constant current;

a second MOS transistor which is a pMOS transistor connected between an other end of the first MOS transistor and the output terminal and having a gate connected to an output of the second constant voltage circuit; and a third MOS transistor which is an nMOS transistor connected between the output terminal and a power supply and having a gate connected to an output of the first constant voltage circuit;

wherein the first constant voltage is set at or below a sum of a threshold voltage of the third MOS transistor and a target voltage which is a target value of the output voltage, and the second constant voltage is set higher than the sum of the target voltage and a threshold voltage of the second MOS transistor.

According to still further aspect of the present invention, there is provided: a power supply circuit that outputs a voltage stepped down from a power supply voltage, comprising:

an output terminal that outputs the output voltage stepped down from the power supply voltage;

a constant voltage circuit that outputs a constant voltage;

a first MOS transistor having one end connected to ground and a gate fed with a fixed voltage to enable passage of a constant current;

a second MOS transistor which is a pMOS transistor connected between an other end of the first MOS transistor and the output terminal;

a third MOS transistor which is an nMOS transistor connected between the output terminal and a power supply and having a gate connected to an output of the constant voltage circuit;

a fourth MOS transistor having one end connected to the ground and a gate fed with the fixed voltage to enable passage of a constant current;

a fifth MOS transistor which is a diode-connected PMOS transistor having one end connected to an other end of the fourth MOS transistor and a gate of the second MOS transistor; and a sixth MOS transistor which is a diode-connected nMOS transistor connected between an other end of the fifth MOS transistor and the output of the constant voltage circuit, wherein the fifth MOS transistor has a threshold voltage set at or above a threshold voltage of the second MOS transistor, and the sixth MOS transistor has a threshold voltage set at or below a threshold voltage of the third MOS transistor.

DETAILED DESCRIPTION

Embodiments to which the present invention is applied will be described below with reference to the accompanying drawings.

First Embodiment

Figure 1:
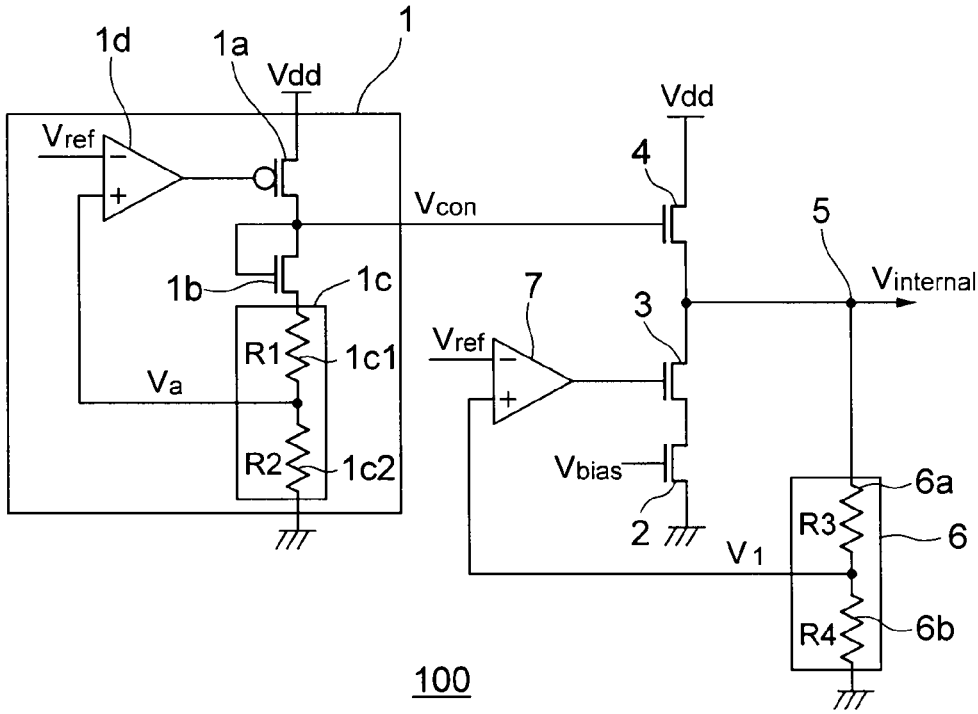
FIG. 1 is a circuit diagram showing an example of the configuration of a power supply circuit 100 according to a first embodiment which is an aspect of the present invention.

FIG. 1 is a circuit diagram showing an example of the configuration of a power supply circuit 100 according to a first embodiment which is an aspect of the present invention.

As shown in FIG. 1, the power supply circuit 100 for outputting a voltage Vinternal stepped down from a power supply voltage Vdd includes a constant voltage circuit 1, a first MOS transistor 2, a second MOS transistor 3, a third MOS transistor 4, an output terminal 5, a first voltage dividing circuit 6, and a first differential amplifier circuit 7.

The constant voltage circuit 1 outputs a constant voltage set at a voltage Vcon. The constant voltage circuit 1 includes a first constant voltage MOS transistor 1*a*, a second constant voltage MOS transistor 1*b*, a constant voltage dividing circuit 1*c*, and a constant voltage differential amplifier circuit 1*d*.

In this configuration, the first constant voltage MOS transistor 1*a* is a pMOS transistor connected between a power supply and the gate of the third MOS transistor 4.

The second constant voltage MOS transistor 1*b* is an nMOS transistor which has one end connected to the gate of the third MOS transistor 4 and is diode-connected.

The threshold voltage of the second constant voltage MOS transistor 1*b* is set to be equal to, for example, the threshold voltage of the third MOS transistor 4. Thus the source potential of the second constant voltage MOS transistor 1*b* can be set to be equal to the source potential (output voltage Vinternal) of the third MOS transistor 4.

The constant voltage dividing circuit 1*c* is connected between the other end (source) of the second constant voltage MOS transistor 1*b* and the ground. The constant voltage dividing circuit 1*c* includes a voltage dividing resistor 1*c*1 having a resistance value R1 and a voltage dividing resistor 1*c*2 which is connected in series with the voltage dividing resistor 1*c*1 and has a resistance value R2.

The constant voltage dividing circuit 1*c* outputs a divided voltage Va obtained by dividing a voltage between the source potential of the second constant voltage MOS transistor 1*b* and the ground by a predetermined voltage dividing ratio of R2/(R1+R2).

The constant voltage differential amplifier circuit 1*d* has the inverting input terminal fed with a reference voltage Vref, the non-inverting input terminal fed with the divided voltage Va, and the output connected to the gate of the first constant voltage MOS transistor 1*a*.

When the divided voltage Va is higher than the reference voltage Vref, the constant voltage differential amplifier circuit 1*d* outputs a signal to turn off the first constant voltage MOS transistor 1*a*. When the divided voltage Va is lower than the reference voltage Vref, the constant voltage differential amplifier circuit 1*d* outputs a signal to turn on the first constant voltage MOS transistor 1*a*. Thus the constant voltage circuit 1 can output the constant voltage Vcon.

In this configuration, the first MOS transistor 2 is an nMOS transistor having one end (source) connected to the ground and the gate fed with a fixed voltage Vbias to enable the passage of a constant current.

The second MOS transistor 3 is an nMOS transistor connected between the other end (drain) of the first MOS transistor 2 and the output terminal 5.

The third MOS transistor 4 is an nMOS transistor connected in series with the second MOS transistor 3 between the other end (drain) of the first MOS transistor 2 and the power supply. The third MOS transistor 4 is connected between the output terminal 5 and the power supply and has the gate connected to the output of the constant voltage circuit 1.

The output terminal 5 is connected between the second MOS transistor 3 and the third MOS transistor 4 and outputs the output voltage Vinternal stepped down from the power supply voltage Vdd.

The first voltage dividing circuit 6 is connected between the output terminal 5 and the ground. The first voltage dividing circuit 6 includes a voltage dividing resistor 6*a* having a resistance value R3 and a voltage dividing resistor 6*b* which is connected in series with the voltage dividing resistor 6*a* and has a resistance value R4.

The first voltage dividing circuit 6 outputs a first divided voltage V1 obtained by dividing the output voltage Vinternal of the output terminal 5 by a first voltage dividing ratio of R4/(R3+R4).

The first differential amplifier circuit 7 has the inverting input terminal fed with the reference voltage Vref, the non-inverting input terminal fed with the first divided voltage V1, and the output connected to the gate of the second MOS transistor 3.

When the first divided voltage V1 is higher than the reference voltage Vref, the first differential amplifier circuit 7 outputs a signal to turn on the second MOS transistor 3. Thus when the condition of Formula (1) is satisfied, the second MOS transistor 3 is turned on and the first MOS transistor 2 is fed with a bleeder current.

$$V\text{internal}\times R4/(R3+R4)>V\text{ref} \quad (1)$$

When the first divided voltage V1 is lower than the reference voltage Vref, the first differential amplifier circuit 7 outputs a signal to turn off the second MOS transistor 3. Thus when the condition of Formula (2) is satisfied, the second MOS transistor 3 is turned off and the bleeder current passing through the first MOS transistor 2 is limited.

$$V\text{internal}\times R4/(R3+R4)<V\text{ref} \quad (2)$$

In this way, the first differential amplifier circuit 7 controls the on/off of the bleeder current passing through the first MOS transistor 2 according to the output voltage Vinternal of the output terminal 5.

Thus when the output voltage Vinternal is lower than a certain threshold value, the bleeder current can be cut to suppress excessive current consumption.

Figure 2:
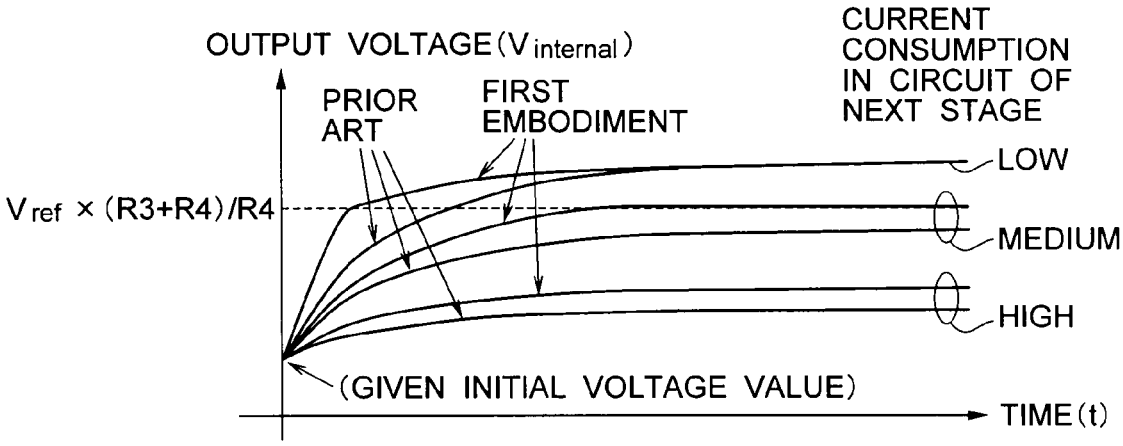
FIG. 2 is a graph showing the relationship between the output voltage V internal and a time t in the power supply circuits of the first embodiment and the prior art.

FIG. 2 shows the relationship between the output voltage Vinternal and a time t in the power supply circuits of the first embodiment and the prior art. FIG. 2 illustrates three patterns having high, medium, and low current consumption in a circuit which is connected to the next stage of the power supply circuit and is fed with the output voltage Vinternal.

As shown in FIG. 2, when the circuit of the next stage has low current consumption, the condition of Formula (1) is satisfied in the power supply circuit of the first embodiment. Since the bleeder current passes through both of the power supply circuit of the first embodiment and the power supply circuit of the prior art, an obtained voltage does not vary between the power supply circuits.

When the circuit of the next stage has high current consumption, the condition of Formula (2) is satisfied in the power supply circuit of the first embodiment. Thus the bleeder current is limited in the power supply circuit of the first embodiment.

For this reason, the obtained voltage of the output voltage Vinternal varies between the power supply circuit of the first embodiment and the power supply circuit of the prior art. To be specific, the output voltage Vinternal is higher in the power supply circuit of the first embodiment than in the power supply circuit of the prior art.

In the case where the circuit of the next stage has medium current consumption, the condition of Formula (1) can be established when the second MOS transistor 3 is turned off, and the condition of Formula (2) can be established when the second MOS transistor 3 is turned on.

It is therefore considered that in the power supply circuit of the first embodiment, the second MOS transistor 3 is repeatedly turned on/off and the relationship of Formula (3) is established in a steady state.

Also in this case, the output voltage Vinternal is higher in the power supply circuit of the first embodiment than in the power supply circuit of the prior art.

$$V\text{internal}\times R4/(R3+R4)=V\text{ref} \quad (3)$$

Thus when the output voltage Vinternal is lower than a certain value (when the circuit of the next stage has high current consumption), the power supply circuit 100 of the first embodiment can suppress current consumption by cutting the bleeder current, as compared with the power supply circuit of the prior art.

As described above, the power supply circuit of the present embodiment can reduce current consumption.

Second Embodiment

The first embodiment described an example of the configuration of the power supply circuit for reducing current consumption by cutting the bleeder current when the output voltage Vinternal is lower than a certain value.

The present embodiment will particularly describe an example of the configuration of a power supply circuit for more minutely controlling a bleeder current.

Figure 3:
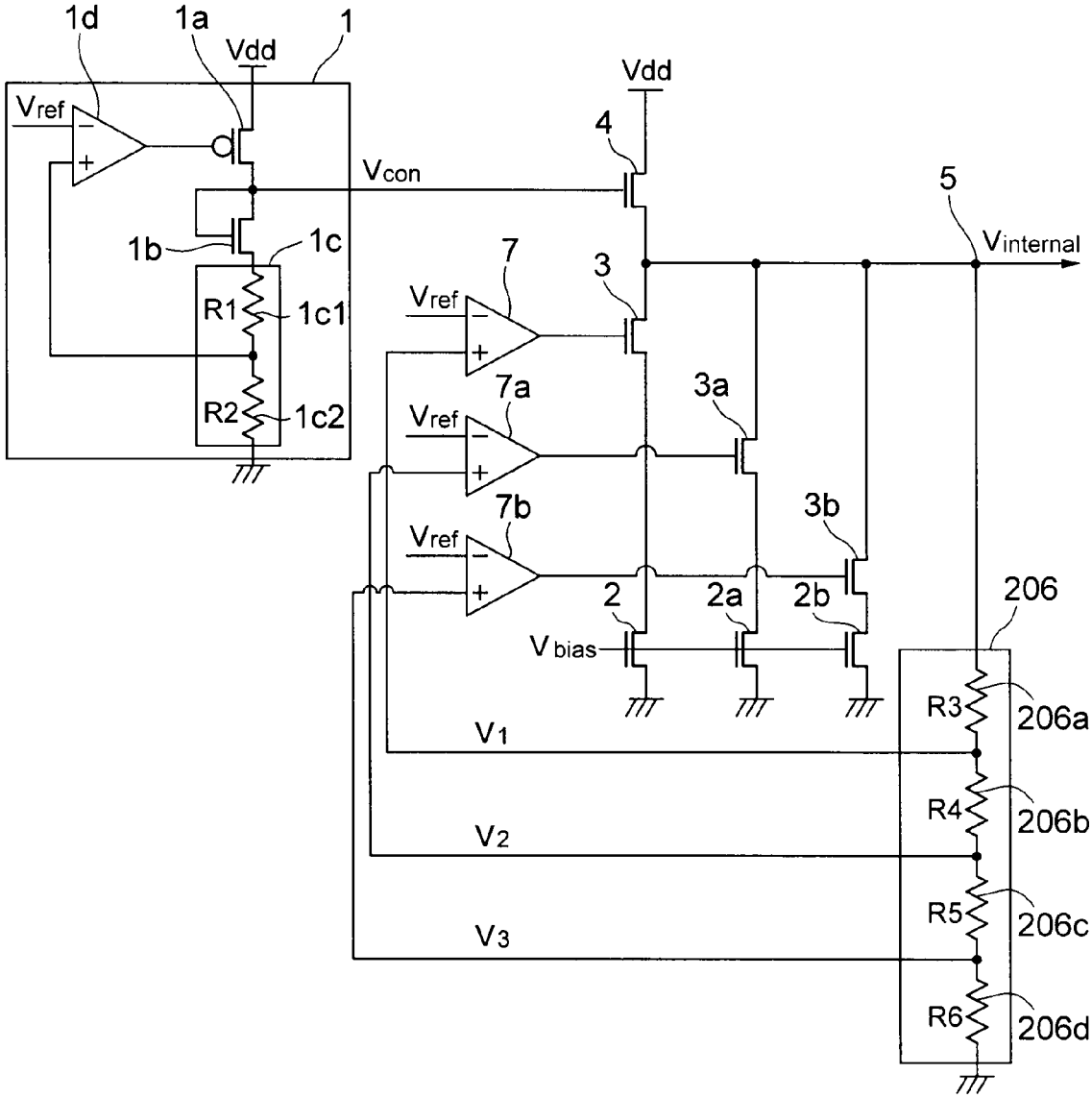
FIG. 3 is a circuit diagram showing an example of the configuration of a power supply circuit 200 according to a second embodiment which is an aspect of the present invention.

FIG. 3 is a circuit diagram showing an example of the configuration of a power supply circuit 200 according to a second embodiment which is an aspect of the present invention. Configurations indicated by the same reference numerals as in the first embodiment are the same configurations as those of the first embodiment.

As shown in FIG. 3, the power supply circuit 200 further includes a fourth MOS transistor 2*a*, a fifth MOS transistor 3*a*, a sixth MOS transistor 2*b*, a seventh MOS transistor 3*b*, a second differential amplifier circuit 7*a*, and a third differential amplifier circuit 7*b*, unlike the power supply circuit 100 of the first embodiment.

In this configuration, the fourth MOS transistor 2*a* is an nMOS transistor having one end (source) connected to the ground and the gate fed with a fixed voltage Vbias to enable the passage of a constant current.

The fifth MOS transistor 3*a* is an nMOS transistor connected between the fourth MOS transistor 2*a* and an output terminal 5.

The sixth MOS transistor 2*b* is an nMOS transistor having one end (source) connected to the ground and the gate fed with the fixed voltage Vbias to enable the passage of a constant current.

The seventh MOS transistor 3*b* is an nMOS transistor connected between the sixth MOS transistor 2*b* and the output terminal 5.

In other words, a first MOS transistor 2 and a second MOS transistor 3 which are connected in series, the fourth MOS transistor 2*a* and the fifth MOS transistor 3*a* which are connected in series, and the sixth MOS transistor 2*b* and the seventh MOS transistor 3*b* which are connected in series are connected in parallel with one another between the ground and the output terminal 5.

For example, the sum of the driving forces of the first MOS transistor 2, the fourth MOS transistor 2*a*, and the sixth MOS transistor 2*b* in the power supply circuit 200 may be equal to the driving force of the first MOS transistor 2 in the power supply circuit 100 of the first embodiment. Thus the maximum bleeder current of the power supply circuit 200 can be made equal to the maximum bleeder current of the power supply circuit 100.

In this configuration, a first voltage dividing circuit 206 is connected between the output terminal 5 and the ground, like the first voltage dividing circuit 6 of the first embodiment. The first voltage dividing circuit 206 includes a voltage dividing resistor 206*a* having a resistance value R3, a voltage dividing resistor 206*b* having a resistance value R4, a voltage dividing resistor 206*c* having a resistance value R5, and a voltage dividing resistor 206*d* having a resistance value R6. The voltage dividing resistors 206*a*, 206*b*, 206*c*, and 206*d* are connected in series between the output terminal 5 and the ground.

The first voltage dividing circuit 206 outputs a first divided voltage V1 obtained by dividing an output voltage Vinternal of the output terminal 5 by a first voltage dividing ratio of (R4+R5+R6)/(R3+R4+R5+R6). Further, the first voltage dividing circuit 206 outputs a second divided voltage V2 obtained by dividing the output voltage Vinternal of the output terminal 5 by a second voltage dividing ratio of (R5+R6)/(R3+R4+R5+R6). Moreover, the first voltage dividing circuit 206 outputs a third divided voltage V3 obtained by dividing the output voltage Vinternal of the output terminal 5 by a third voltage dividing ratio of R6/(R3+R4+R5+R6).

In other words, the first voltage dividing circuit 206 can output the plurality of different divided voltages.

In this configuration, when the first divided voltage V1 is higher than a reference voltage Vref, a first differential amplifier circuit 7 outputs a signal to turn on a second MOS transistor 3 as in the first embodiment. Thus when the condition of Formula (4) is satisfied, the second MOS transistor 3 is turned on and the bleeder current passes through the first MOS transistor 2.

$$V\text{internal}\times(R4+R5+R6)/(R3+R4+R5+R6)>V\text{ref} \quad (4)$$

When the first divided voltage V1 is lower than the reference voltage Vref, the first differential amplifier circuit 7 outputs a signal to turn off the second MOS transistor 3 as in the first embodiment. Thus when the condition of Formula (5) is satisfied, the second MOS transistor 3 is turned off and the bleeder current passing through the first MOS transistor 2 is limited.

$$V\text{internal}\times(R4+R5+R6)/(R3+R4+R5+R6)<V\text{ref} \quad (5)$$

The second differential amplifier circuit 7*a* has the inverting input terminal fed with the reference voltage Vref, the non-inverting input terminal fed with the second divided voltage V2, and the output connected to the gate of the fifth MOS transistor 3*a*.

When the second divided voltage V2 is higher than the reference voltage Vref, the second differential amplifier circuit 7*a* outputs a signal to turn on the fifth MOS transistor 3*a*. Thus when the condition of Formula (6) is satisfied, the fifth MOS transistor 3*a* is turned on and the bleeder current passes through the fourth MOS transistor 2*a*.

$$V\text{internal}\times(R5+R6)/(R3+R4+R5+R6)>V\text{ref} \quad (6)$$

When the second divided voltage V2 is lower than the reference voltage Vref, the second differential amplifier circuit 7*a* outputs a signal to turn off the fifth MOS transistor 3*a*. Thus when the condition of Formula (7) is satisfied, the fifth MOS transistor 3*a* is turned off and the bleeder current passing through the fourth MOS transistor 2*a* is limited.

$$V\text{internal}\times(R5+R6)/(R3+R4+R5+R6)<V\text{ref} \quad (7)$$

The third differential amplifier circuit 7*b* has the inverting input terminal fed with the reference voltage Vref, the non-inverting input terminal fed with the third divided voltage V3, and the output connected to the gate of the seventh MOS transistor 3*b*.

When the third divided voltage V3 is higher than the reference voltage Vref, the third differential amplifier circuit 7*b* outputs a signal to turn on the seventh MOS transistor 3*b*. Thus when the condition of Formula (8) is satisfied, the seventh MOS transistor 3*b* is turned on and the bleeder current passes through the sixth MOS transistor 2*b*.

$$V\text{internal}\times R6/(R3+R4+R5+R6)>V\text{ref} \quad (8)$$

When the third divided voltage V3 is lower than the reference voltage Vref, the third differential amplifier circuit 7*b* outputs a signal to turn off the seventh MOS transistor 3*b*. Thus when the condition of Formula (9) is satisfied, the seventh MOS transistor 3*b* is turned off and the bleeder current passing through the sixth MOS transistor 2*b* is limited.

$$V\text{internal}\times R6/(R3+R4+R5+R6)<V\text{ref} \quad (9)$$

With this configuration, the output voltage Vinternal is increased, the second MOS transistor 3, the fifth MOS transistor 3*a*, and the seventh MOS transistor 3*b* are sequentially turned on, and the bleeder current is also increased.

As described above, the power supply circuit 200 can more minutely control the bleeder current than the power supply circuit 100 of the first embodiment.

Thus the power supply circuit 200 of the second embodiment can reduce current consumption while more minutely controlling the output voltage Vinternal than the power supply circuit 100 of the first embodiment.

In the present embodiment, a bleeder is divided into three systems. The bleeder may be similarly divided into two systems or four or more systems.

As described above, the power supply circuit of the present embodiment can reduce current consumption.

Third Embodiment

The first and second embodiments described examples of the configuration of the power supply circuit for reducing current consumption by cutting the bleeder current when the output voltage Vinternal is lower than a certain value.

The present embodiment will describe another structural example of a power supply circuit for controlling a bleeder current.

Figure 4:
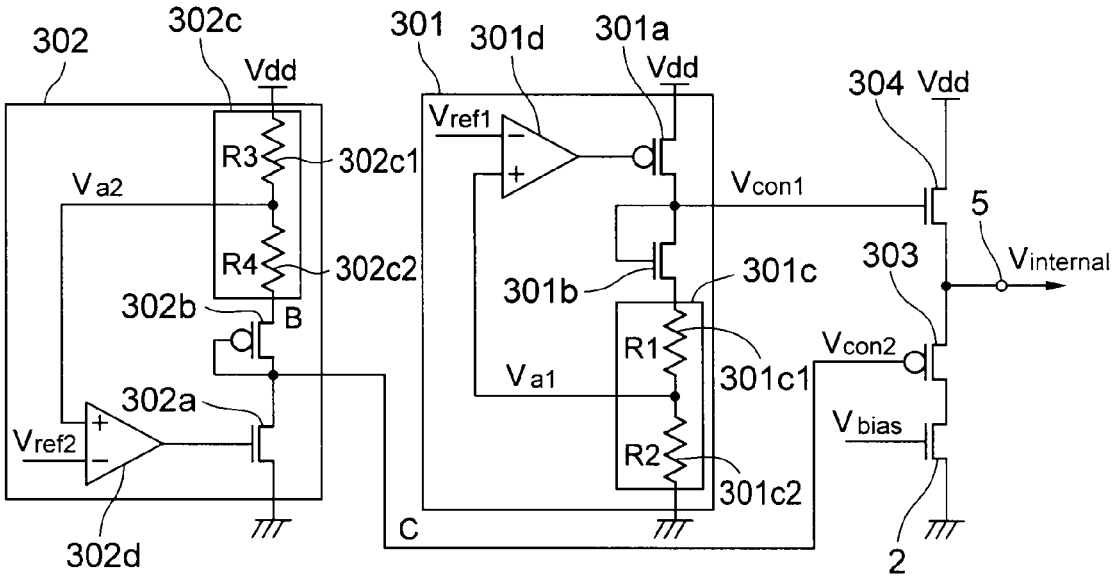
FIG. 4 is a circuit diagram showing an example of the configuration of a power supply circuit 300 according to a third embodiment which is an aspect of the present invention.

FIG. 4 is a circuit diagram showing an example of the configuration of a power supply circuit 300 according to a third embodiment which is an aspect of the present invention. Configurations indicated by the same reference numerals as in the first embodiment are the same configurations as those of the first embodiment.

As shown in FIG. 4, the power supply circuit 300 for outputting a voltage Vinternal stepped down from a power supply voltage Vdd includes a first constant voltage circuit 301, a second constant voltage circuit 302, an output terminal 5, a first MOS transistor 2, a second MOS transistor 303, and a third MOS transistor 304.

In this configuration, the first MOS transistor 2 is an nMOS transistor having one end (source) connected to the ground and the gate fed with a fixed voltage Vbias to enable the passage of a constant current.

The second MOS transistor 303 is a PMOS transistor which is connected between the other end (drain) of the first MOS transistor 2 and the output terminal 5 and has the gate connected to the output of the second constant voltage circuit 302. For example, the second MOS transistor 303 is designed to be larger in size than a fourth constant voltage MOS transistor 302*b*.

The third MOS transistor 304 is an nMOS transistor which is connected between the output terminal 5 and a power supply and has the gate connected to the output of the first constant voltage circuit 301. The third MOS transistor 304 is designed to be larger in size than, for example, a second constant voltage MOS transistor 301*b*.

The first constant voltage circuit 301 outputs a first constant voltage set at a voltage Vcon1. The first constant voltage is set at or below the sum of a target voltage Vtarget, which is a target value (set value) of the output voltage Vinternal, and the threshold voltage of the third MOS transistor 304.

The first constant voltage circuit 301 includes, for example, a first constant voltage MOS transistor 301*a*, the second constant voltage MOS transistor 301*b*, a constant voltage dividing circuit 301*c*, and a constant voltage differential amplifier circuit 301*d*, like the constant voltage circuit of the first embodiment.

In this configuration, the first constant voltage MOS transistor 301*a* is a pMOS transistor connected between the power supply and the gate of the third MOS transistor 304.

The second constant voltage MOS transistor 301*b* is an nMOS transistor which has one end (drain) connected to the gate of the third MOS transistor 304 and is diode-connected.

The threshold voltage of the second constant voltage MOS transistor 301*b* is set to be equal to, for example, the threshold voltage of the third MOS transistor 304. Thus the source potential of the second constant voltage MOS transistor 301*b* can be set to be equal to the source potential (output voltage Vinternal) of the third MOS transistor 304.

The constant voltage dividing circuit 301*c* is connected between the other end (source) of the second constant voltage MOS transistor 301*b* and the ground. The constant voltage dividing circuit 301*c* includes a voltage dividing resistor 301*c*1 having a resistance value R1 and a voltage dividing resistor 301*c*2 which is connected in series with the voltage dividing resistor 301*c*1 and has a resistance value R2. The resistance value R1 and the resistance value R2 are selected such that, for example, the source potential of the second constant voltage MOS transistor 301*b* is equal to the target voltage Vtarget.

The constant voltage dividing circuit 301*c* outputs a divided voltage Va1 obtained by dividing a voltage between the second constant voltage MOS transistor 301*b* and the ground by a predetermined voltage dividing ratio of R2/(R1+R2).

The constant voltage differential amplifier circuit 301*d* has the inverting input terminal fed with a reference voltage Vref1, the non-inverting input terminal fed with the divided voltage Va1, and the output connected to the gate of the first constant voltage MOS transistor 301*a*.

When the divided voltage Va1 is higher than the reference voltage Vref1, the constant voltage differential amplifier circuit 301*d* outputs a signal to turn off the first constant voltage MOS transistor 301*a*. When the divided voltage Va1 is lower than the reference voltage Vref1, the constant voltage differential amplifier circuit 301*d* outputs a signal to turn on the first constant voltage MOS transistor 301*a*. Thus the first constant voltage circuit 301 can output the constant voltage Vcon1.

The second constant voltage circuit 302 outputs a second constant voltage set at a voltage Vcon2. The second constant voltage is set to be equal to the sum of the target voltage Vtarget of the output voltage Vinternal and the threshold voltage of the second MOS transistor 303.

The second constant voltage circuit 302 includes, for example, a third constant voltage MOS transistor 302*a*, the fourth constant voltage MOS transistor 302*b*, a constant voltage dividing circuit 302*c*, and a constant voltage differential amplifier circuit 302*d*.

In this configuration, the third constant voltage MOS transistor 302*a* is an nMOS transistor connected between the ground and the gate of the second MOS transistor 303.

The fourth constant voltage MOS transistor 302*b* is a PMOS transistor which has one end (drain) connected to the gate of the second MOS transistor 303 and is diode-connected.

The threshold voltage of the fourth constant voltage MOS transistor 302*b* is set to be equal to, for example, the threshold voltage of the second MOS transistor 303. Thus the source potential of the fourth constant voltage MOS transistor 302*b* can be set to be equal to the source potential (output voltage Vinternal) of the second MOS transistor 303.

The constant voltage dividing circuit 302*c* is connected between the other end (source) of the fourth constant voltage MOS transistor 302*b* and the ground. The constant voltage dividing circuit 302*c* includes a voltage dividing resistor 302*c*1 having a resistance value R3 and a voltage dividing resistor 302*c*2 which is connected in series with the voltage dividing resistor 302*c*1 and has a resistance value R4. The resistance value R3 and the resistance value R4 are selected such that, for example, the source potential of the fourth constant voltage MOS transistor 302*b* is equal to the target voltage Vtarget.

The constant voltage dividing circuit 302*c* outputs a divided voltage Va2 obtained by dividing a voltage between the fourth constant voltage MOS transistor 302*b* and the power supply by a predetermined voltage dividing ratio of R4/(R3+R4).

The constant voltage differential amplifier circuit 302*d* has the inverting input terminal fed with a reference voltage Vref2, the non-inverting input terminal fed with the divided voltage Va2, and the output connected to the gate of the third constant voltage MOS transistor 302*a*.

When the divided voltage Va2 is higher than the reference voltage Vref2, the constant voltage differential amplifier circuit 302*d* outputs a signal to turn on the third constant voltage MOS transistor 302*a*. When the divided voltage Va2 is lower than the reference voltage Vref2, the constant voltage differential amplifier circuit 302*d* outputs a signal to turn off the third constant voltage MOS transistor 302*a*.

Thus the second constant voltage circuit 302 can output the constant voltage Vcon2.

In the power supply circuit 300 configured thus, when the output voltage Vinternal is equal to the target voltage Vtarget, the second MOS transistor 303 and the third MOS transistor 304 may be simultaneously turned on. In this case, a flow-through current passes through the third MOS transistor 304, the second MOS transistor 303, and the first MOS transistor 2.

When the output voltage Vinternal has a voltage value in a range around the target voltage Vtarget (hereinafter, will be referred to as a dead zone), it is necessary to turn off the second MOS transistor 303 and the third MOS transistor 304.

The following will describe conditions for setting the dead zone for turning off the second MOS transistor 303 and the third MOS transistor 304.

(a) Through a feedback loop made up of the third constant voltage MOS transistor 302*a*, the fourth constant voltage MOS transistor 302*b*, the constant voltage dividing circuit 302*c*, and the constant voltage differential amplifier circuit 302*d*, the voltage of a node B is controlled to the target voltage Vtarget.

Thus when the fourth constant voltage MOS transistor 302*b* has a threshold voltage of Vth302*b* (<0 V), the voltage Vcon2 is the sum of the target voltage Vtarget and the threshold voltage Vth302*b*.

In this case, when the second MOS transistor 303 has a threshold voltage of Vth303 (<0 V), Vth302*b*=Vth303+ΔV2 is set where "ΔV2" is a voltage higher than 0 V.

The second MOS transistor 303 is turned on when the output voltage Vinternal is higher than the sum of the target voltage Vtarget and "ΔV2".

The second MOS transistor 303 is turned off when the output voltage Vinternal is lower than the sum of the target voltage Vtarget and "ΔV2". Thus the bleeder current passing through the first MOS transistor 2 is limited.

In other words, the output voltage Vinternal is controlled with the dead zone of Vtarget+ΔV2>Vinternal>Vtarget.

As described above, when the output voltage Vinternal is lower than a certain value (when the circuit of the next stage has high current consumption), the power supply circuit 300 of the third embodiment can suppress current consumption by cutting the bleeder current while suppressing the occurrence of the flow-though current.

Instead of (a), (b) the threshold voltage of the third MOS transistor may be set higher than the threshold voltage of the second constant voltage MOS transistor 301*b*. Also in this case, it is possible to set the dead zone for turning off the second MOS transistor 303 and the third MOS transistor 304.

Instead of (a), (c) the voltage dividing ratio of R2/(R1+R2) may be increased. Also in this case, it is possible to set the dead zone for turning off the second MOS transistor 303 and the third MOS transistor 304.

Instead of (a), (d) the voltage dividing ratio of R4/(R3+R4) may be reduced. Also in this case, it is possible to set the dead zone for turning off the second MOS transistor 303 and the third MOS transistor 304.

As described above, the power supply circuit of the present embodiment can reduce current consumption.

Fourth Embodiment

The first to third embodiments described examples of the configuration of the power supply circuit for reducing current consumption by cutting the bleeder current when the output voltage Vinternal is lower than a certain value.

The present embodiment will describe an example of the configuration of a power supply circuit for controlling a bleeder current without using a feedback loop for an output voltage.

Figure 5:
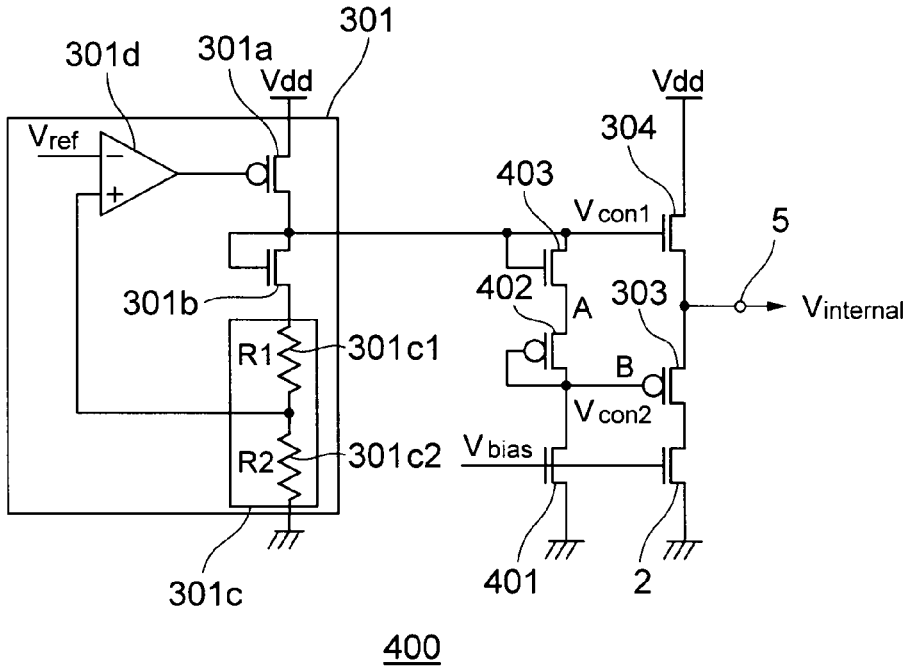
FIG. 5 is a circuit diagram showing an example of the configuration of a power supply circuit 400 according to a fourth embodiment which is an aspect of the present invention.

FIG. 5 is a circuit diagram showing an example of the configuration of a power supply circuit 400 according to a fourth embodiment which is an aspect of the present invention. Configurations indicated by the same reference numerals as in the first and third embodiments are the same configurations as those of the first and third embodiments.

As shown in FIG. 5, the power supply circuit 400 for outputting a voltage Vinternal stepped down from a power supply voltage Vdd includes an output terminal 5, a constant voltage circuit 301, a first MOS transistor 2, a second MOS transistor 303, a third MOS transistor 304, a fourth MOS transistor 401, a fifth MOS transistor 402, and a sixth MOS transistor 403.

As in the third embodiment, the constant voltage circuit 301 outputs a constant voltage set at a voltage Vcon1.

In this configuration, the first MOS transistor 2 is an nMOS transistor having one end (source) connected to the ground and the gate fed with a fixed voltage Vbias to enable the passage of a constant current.

The second MOS transistor 303 is a pMOS transistor connected between the other end (drain) of the first MOS transistor 2 and the output terminal 5.

The third MOS transistor 304 is an nMOS transistor which is connected between the output terminal 5 and a power supply and has the gate connected to the output of the constant voltage circuit 301.

The fourth MOS transistor 401 is an nMOS transistor which has one end (source) connected to the ground and has the gate fed with the fixed voltage Vbias to enable the passage of a constant current.

The fifth MOS transistor 402 is a pMOS transistor which has one end (drain) connected to the other end (drain) of the fourth MOS transistor 401 and the gate of the second MOS transistor 303 and is diode-connected. The threshold voltage of the fifth MOS transistor 402 is set at or above the threshold voltage of the second MOS transistor 303.

The sixth MOS transistor 403 is an nMOS transistor which is connected between the other end (source) of the fifth MOS transistor 402 and the output of the constant voltage circuit 301 and is diode-connected. The threshold voltage of the sixth MOS transistor 403 is set at or below the threshold voltage of the third MOS transistor 304.

The following will describe conditions and operations for cutting excessive bleeder current in the power supply circuit 400 configured thus.

When it is assumed that the third MOS transistor 304 has a threshold voltage of Vth304, a threshold voltage Vth403 of the sixth MOS transistor 403 is set at Vth304−ΔV1.

Further, when it is assumed that the second MOS transistor 303 has a threshold voltage of Vth303 (<0 V), a threshold voltage Vth402 of the fifth MOS transistor 402 is set at Vth303+ΔV2.

In order to prevent the second MOS transistor 303 and the third MOS transistor 304 from being simultaneously turned on to pass a flow-through current, the sum of "ΔV1" and "ΔV2" is set larger than 0 V. At this point, the voltage (Vcon2) of a node B has a potential higher than a target value Vtarget by "ΔV1".

Thus the voltage Vcon2 of the node B is expressed by Formula (10) where ΔV=ΔV1+ΔV2 is established.

$$V\text{con2}=V\text{target}-|V\text{th303}|+\Delta V \quad (10)$$

Thus the second MOS transistor 303 is turned on when the output voltage Vinternal is higher than the sum of the target voltage Vtarget and "ΔV". On the other hand, the second MOS transistor 303 is turned off when the output voltage Vinternal is lower than the sum of the target voltage Vtarget and "ΔV".

As described above, the power supply circuit 400 of the fourth embodiment can suppress current consumption by cutting the bleeder current when the output voltage Vinternal is lower than a certain value (when the circuit of the next stage has high current consumption).

The potential of a node A may be increased by the subthreshold currents of the fifth MOS transistor 402 and the sixth MOS transistor 403. Thus as described above, the fourth MOS transistor 401 is provided as a bleeder.

The fifth and sixth MOS transistors 402 and 403 may be smaller in size than the third MOS transistor 304. Thus the bleeder current passing through the fourth MOS transistor 401 can be considerably limited.

As described above, the power supply circuit of the present embodiment can reduce current consumption.

Fifth Embodiment

The fourth embodiment described an example of the configuration of the power supply circuit for reducing current consumption by cutting the bleeder current without using a feedback loop for the output voltage when the output voltage Vinternal is lower than a certain value.

A fifth embodiment will describe an example of the configuration of a power supply circuit which is a modification of the configuration of the fourth embodiment.

Figure 6:
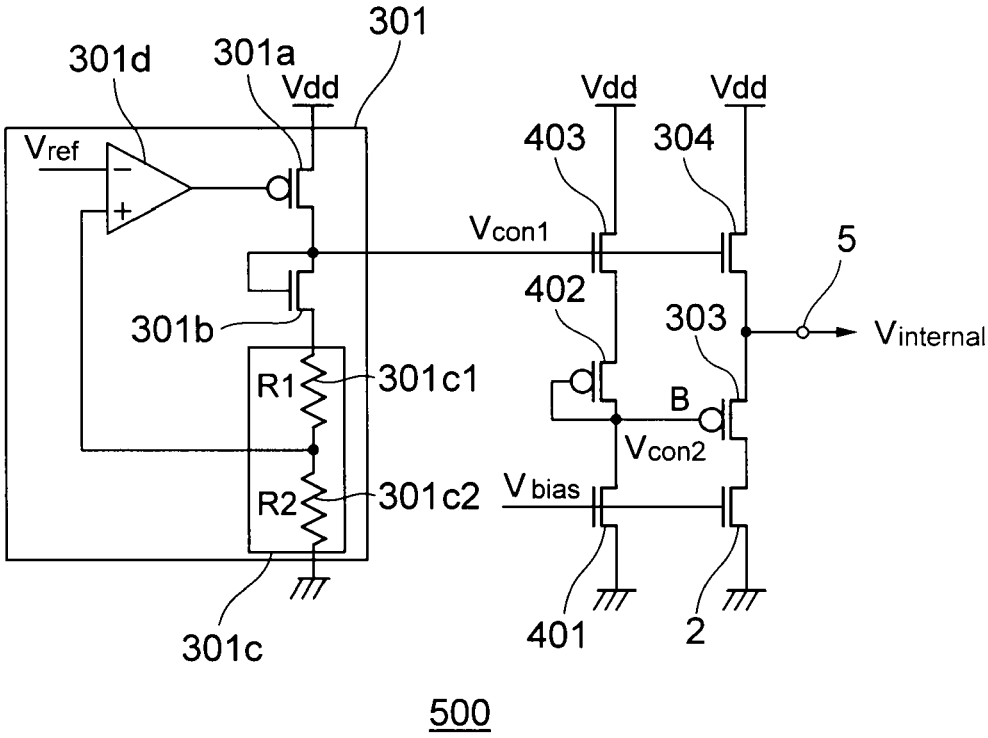
FIG. 6 is a circuit diagram showing an example of the configuration of a power supply circuit 500 according to the fifth embodiment which is an aspect of the present invention.

FIG. 6 is a circuit diagram showing an example of the configuration of a power supply circuit 500 according to the fifth embodiment which is an aspect of the present invention.

Configurations indicated by the same reference numerals as in the fourth embodiment are the same configurations as those of the fourth embodiment.

As shown in FIG. 6, the power supply circuit 500 for outputting a voltage Vinternal stepped down from a power supply voltage Vdd includes an output terminal 5, a constant voltage circuit 301, a first MOS transistor 2, a second MOS transistor 303, a third MOS transistor 304, a fourth MOS transistor 401, a fifth MOS transistor 402, and a sixth MOS transistor 403, like the power supply circuit 400 of the fourth embodiment.

Unlike the fourth embodiment, the sixth MOS transistor 403 is connected between the other end (source) of the fifth MOS transistor 402 and a power supply and has the gate connected to the output of the constant voltage circuit 301.

Also when the sixth MOS transistor 403 is connected thus, the power supply circuit 500 can perform the same operations as in the fourth embodiment.

In other words, the second MOS transistor 303 is turned on when the output voltage Vinternal is higher than the sum of a target voltage Vtarget and "ΔV". When the second MOS transistor 303 is turned off when the output voltage Vinternal is lower than the sum of the target voltage Vtarget and "ΔV".

As described above, the power supply circuit 500 of the fifth embodiment can suppress current consumption by cutting a bleeder current when the output voltage Vinternal is lower than a certain value (when the circuit of the next stage has high current consumption).

As described above, the power supply circuit of the present embodiment can reduce current consumption.

Sixth Embodiment

The fifth embodiment described an example of the configuration of the power supply circuit which is a modification of the configuration of the fourth embodiment.

A sixth embodiment will describe another example of the configuration of a power supply circuit which is a modification of the configuration of the fourth embodiment.

Figure 7:
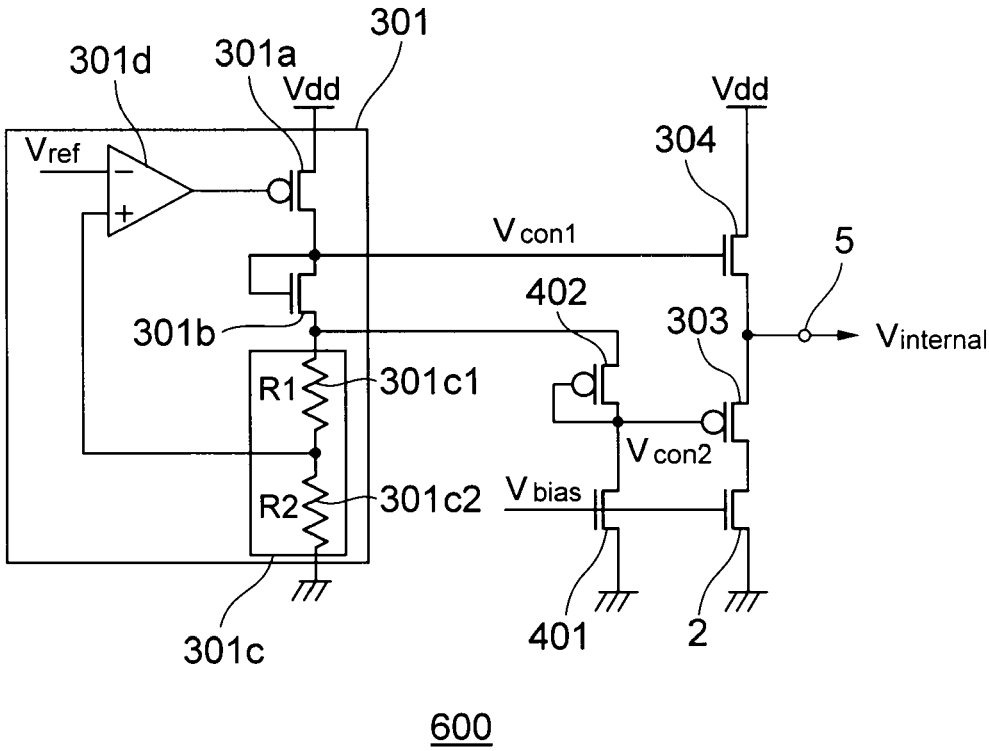
FIG. 7 is a circuit diagram showing an example of the configuration of a power supply circuit 600 according to the sixth embodiment which is an aspect of the present invention.

FIG. 7 is a circuit diagram showing an example of the configuration of a power supply circuit 600 according to the sixth embodiment which is an aspect of the present invention. Configurations indicated by the same reference numerals as in the fourth embodiment are the same configurations as those of the fourth embodiment.

As shown in FIG. 7, the power supply circuit 600 for outputting a voltage Vinternal stepped down from a power supply voltage Vdd includes an output terminal 5, a constant voltage circuit 301, a first MOS transistor 2, a second MOS transistor 303, a third MOS transistor 304, a fourth MOS transistor 401, and a fifth MOS transistor 402, like the power supply circuit 400 of the fourth embodiment.

The function of the sixth MOS transistor 403 according to the fourth embodiment is included in a second constant voltage MOS transistor 301*b* and thus the illustration thereof is omitted.

In this configuration, the threshold voltages of the third MOS transistor 304 and the second constant voltage MOS transistor 301*b* are set to be equal to each other. In other words, "ΔV1" described in the fourth embodiment is 0 V.

Thus in order to prevent the second MOS transistor 303 and the third MOS transistor 304 from being simultaneously turned on to pass a flow-through current, the threshold voltage of the fifth MOS transistor 402 has to be set at a value higher than the threshold value of the second MOS transistor 303 (smaller in terms of absolute value). In other words, "ΔV2" described in the fourth embodiment has to be set larger than 0 V.

Also when a sixth MOS transistor 403 is omitted thus, the power supply circuit 600 can perform the same operations as in the fourth embodiment.

In other words, the second MOS transistor 303 is turned on when the output voltage Vinternal is higher than the sum of a target voltage Vtarget and "ΔV". The second MOS transistor 303 is turned off when the output voltage Vinternal is lower than the sum of the target voltage Vtarget and "ΔV".

As described above, the power supply circuit 600 of the sixth embodiment can suppress current consumption by cutting a bleeder current when the output voltage Vinternal is lower than a certain value (when the circuit of the next stage has high current consumption).

As described above, the power supply circuit of the present embodiment can reduce current consumption.

Seventh Embodiment

The sixth embodiment described an example of the configuration of the power supply circuit which is a modification of the configuration of the fourth embodiment.

A seventh embodiment will describe an example of the configuration of a power supply circuit which is a modification of the configuration of the sixth embodiment.

Figure 8:
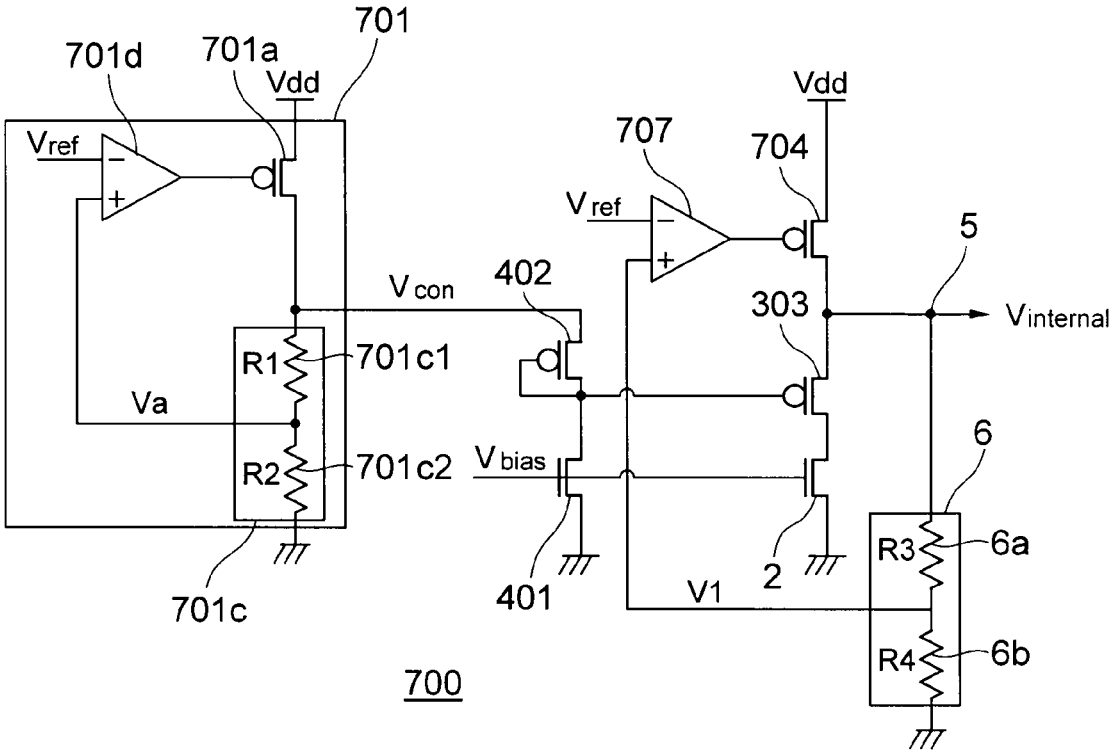
FIG. 8 is a circuit diagram showing an example of the configuration of a power supply circuit 700 according to the seventh embodiment which is an aspect of the present invention.

FIG. 8 is a circuit diagram showing an example of the configuration of a power supply circuit 700 according to the seventh embodiment which is an aspect of the present invention. Configurations indicated by the same reference numerals as in the first and sixth embodiments are the same configurations as those of the first and sixth embodiments.

As shown in FIG. 8, the power supply circuit 700 for outputting a voltage Vinternal stepped down from a power supply voltage Vdd includes an output terminal 5, a voltage dividing circuit 6, a constant voltage circuit 701, a first MOS transistor 2, a second MOS transistor 303, a third MOS transistor 704, a fourth MOS transistor 401, a fifth MOS transistor 402, and a differential amplifier circuit 707.

The constant voltage circuit 701 includes a constant voltage MOS transistor 701*a*, a constant voltage dividing circuit 701*c*, and a constant voltage differential amplifier circuit 701*d*.

The constant voltage MOS transistor 701*a* is a PMOS transistor connected between a power supply and the source of the fifth MOS transistor 402.

The constant voltage dividing circuit 701*c* is connected between one end (drain) of the constant voltage MOS transistor 701*a* and the ground. The constant voltage dividing circuit 701*c* includes a voltage dividing resistor 701*c*1 having a resistance value R1 and a voltage dividing resistor 701*c*2 which is connected in series with the voltage dividing resistor 701*c*1 and has a resistance value R2. The resistance value R1 and the resistance value R2 are selected such that, for example, the drain potential of the constant voltage MOS transistor 701*a* is equal to a target voltage Vtarget.

The constant voltage dividing circuit 701*c* outputs a divided voltage Va obtained by dividing a voltage between the constant voltage MOS transistor 701*a* and the ground by a predetermined voltage dividing ratio of R2/(R1+R2).

The constant voltage differential amplifier circuit 701*d* has the inverting input terminal fed with a reference voltage Vref, the non-inverting input terminal fed with the divided voltage Va, and the output connected to the gate of the constant voltage MOS transistor 701*a*.

When the divided voltage Va is higher than the reference voltage Vref, the constant voltage differential amplifier circuit 701*d* outputs a signal to turn off the first constant voltage MOS transistor 701*a*. When the divided voltage Va is lower than the reference voltage Vref, the constant voltage differential amplifier circuit 701*d* outputs a signal to turn on the constant voltage MOS transistor 701*a*. Thus the constant voltage circuit 701 operates to output a constant voltage Vcon. Thus the drain potential of the fifth MOS transistor 402 is kept at a constant voltage.

When a divided voltage V1 is higher than the reference voltage Vref, the differential amplifier circuit 707 outputs a signal to turn off the third MOS transistor 704. When the divided voltage V1 is lower than the reference voltage Vref, the differential amplifier circuit 707 outputs a signal to turn on the third MOS transistor 704.

As in the sixth embodiment, the second MOS transistor 303 is turned on when the output voltage Vinternal is higher than a predetermined value. The second MOS transistor 303 is turned off when the output voltage Vinternal is lower than the predetermined value.

As described above, the power supply circuit 700 of the seventh embodiment can suppress current consumption by cutting a bleeder current when the output voltage Vinternal is lower than a certain value (when the circuit of the next stage has high current consumption).

As described above, the power supply circuit of the present embodiment can reduce current consumption.

Eighth Embodiment

The seventh embodiment described an example of the configuration of the power supply circuit which is a modification of the configuration of the sixth embodiment.

An eighth embodiment will describe an example of the configuration of a power supply circuit which is a modification of the configuration of the seventh embodiment.

Figure 9:
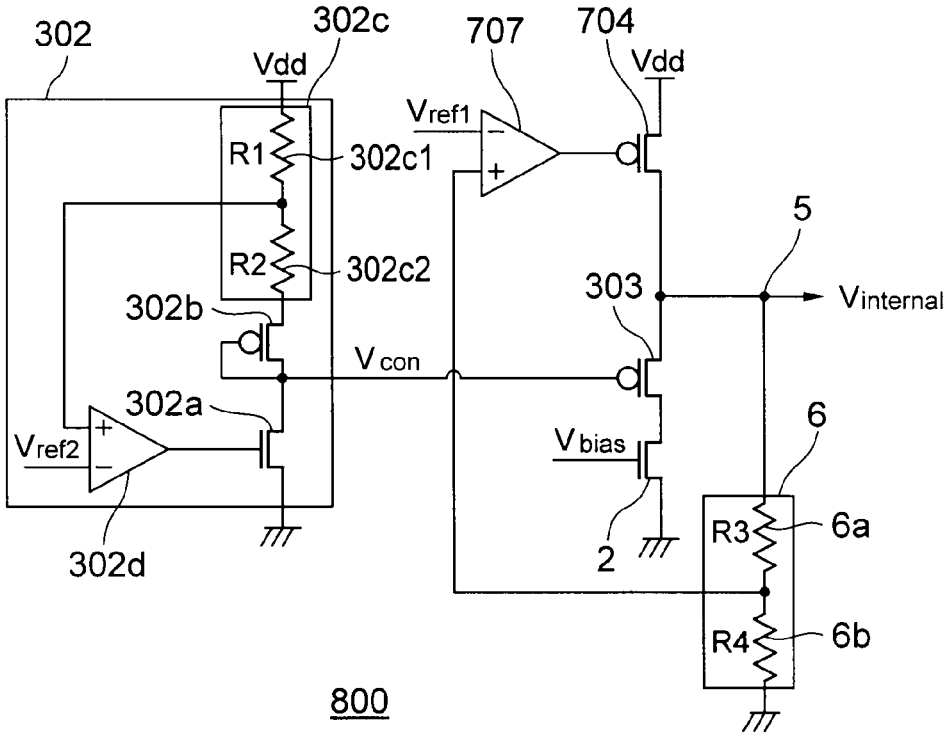
FIG. 9 is a circuit diagram showing an example of the configuration of a power supply circuit 800 according to the eighth embodiment which is an aspect of the present invention.

FIG. 9 is a circuit diagram showing an example of the configuration of a power supply circuit 800 according to the eighth embodiment which is an aspect of the present invention. Configurations indicated by the same reference numerals as in the first, third, and seventh embodiments are the same configurations as those of the first, third, and seventh embodiments.

As shown in FIG. 9, the power supply circuit 800 for outputting a voltage Vinternal stepped down from a power supply voltage Vdd includes an output terminal 5, a voltage dividing circuit 6, a constant voltage circuit 302, a first MOS transistor 2, a second MOS transistor 303, a third MOS transistor 704, and a differential amplifier circuit 707.

As described above, the constant voltage circuit 302 indicated by the same reference numeral as the second constant voltage circuit 302 of the third embodiment has the same configuration as the second constant voltage circuit 302 of the third embodiment. The constant voltage circuit 302 for outputting a constant voltage has the output connected to the gate of the second MOS transistor 303.

In the power supply circuit 800 configured thus, the second MOS transistor 303 is turned on when the output voltage Vinternal is higher than a predetermined value, as in the seventh embodiment. The second MOS transistor 303 is turned off when the output voltage Vinternal is lower than the predetermined value.

As described above, the power supply circuit 800 of the eighth embodiment can suppress current consumption by cutting a bleeder current when the output voltage Vinternal is lower than a certain value (when the circuit of the next stage has high current consumption).

What is claimed is:

1. A power supply circuit that outputs a voltage stepped down from a power supply voltage, comprising:

a constant voltage circuit that outputs a constant voltage;

a first MOS transistor having one end connected to ground and a gate fed with a fixed voltage;

a second MOS transistor having one end connected to an other end of the first MOS transistor;

a third MOS transistor which is connected between an other end of the second MOS transistor and the power supply and has a gate connected to an output of the constant voltage circuit;

an output terminal connected between the second MOS transistor and the third MOS transistor to output the output voltage stepped down from the power supply voltage;

a first voltage dividing circuit that outputs a first divided voltage obtained by dividing the voltage of the output terminal by a first voltage dividing ratio; and a first differential amplifier circuit which is fed with a reference voltage and the first divided voltage and has an output connected to a gate of the second MOS transistor, wherein the first differential amplifier circuit outputs a signal to turn on the second MOS transistor when the first divided voltage is higher than the reference voltage, and the first differential amplifier circuit outputs a signal to turn off the second MOS transistor when the first divided voltage is lower than the reference voltage.

2. The power supply circuit according to claim 1, further comprising:

a fourth MOS transistor having one end connected to the ground and a gate fed with a fixed voltage;

a fifth MOS transistor connected between the fourth MOS transistor and the output terminal; and a second differential amplifier circuit which is fed with the reference voltage and a second divided voltage and has an output connected to a gate of the fifth MOS transistor, the second divided voltage being obtained by dividing, by the first voltage dividing circuit, the voltage of the output terminal by a second voltage dividing ratio different from the first voltage dividing ratio, and outputted from the first voltage dividing circuit, wherein the second differential amplifier circuit outputs a signal to turn on the fifth MOS transistor when the second divided voltage is higher than the reference voltage, and the second differential amplifier circuit outputs a signal to turn off the fifth MOS transistor when the second divided voltage is lower than the reference voltage.

3. The power supply circuit according to claim 1, wherein the constant voltage circuit comprises:

a first constant voltage MOS transistor connected between the power supply and the gate of the third MOS transistor;

a second constant voltage MOS transistor which has one end connected to the gate of the third MOS transistor and is diode-connected;

a constant voltage dividing circuit connected between an other end of the second constant voltage MOS transistor and the ground to output a divided voltage determined by a predetermined voltage dividing ratio; and a constant voltage differential amplifier circuit which is fed with a reference voltage and the divided voltage and has an output connected to a gate of the first constant voltage MOS transistor.

4. The power supply circuit according to claim 2, wherein the constant voltage circuit comprises:

a first constant voltage MOS transistor connected between the power supply and the gate of the third MOS transistor;

a second constant voltage MOS transistor which has one end connected to the gate of the third MOS transistor and is diode-connected;

a constant voltage dividing circuit connected between an other end of the second constant voltage MOS transistor and the ground to output a divided voltage determined by a predetermined voltage dividing ratio; and a constant voltage differential amplifier circuit which is fed with a reference voltage and the divided voltage and has an output connected to a gate of the first constant voltage MOS transistor.

5. The power supply circuit according to claim 3, wherein the second constant voltage MOS transistor has a threshold voltage set at the threshold voltage of the third MOS transistor.

6. The power supply circuit according to claim 4, wherein the second constant voltage MOS transistor has a threshold voltage set at the threshold voltage of the third MOS transistor.

7. A power supply circuit that outputs a voltage stepped down from a power supply voltage, comprising:

an output terminal that outputs the output voltage stepped down from the power supply voltage;

a first constant voltage circuit that outputs a first constant voltage;

a second constant voltage circuit that outputs a second constant voltage;

a first MOS transistor having one end connected to ground and a gate fed with a fixed voltage;

a second MOS transistor which is a pMOS transistor connected between an other end of the first MOS transistor and the output terminal and having a gate connected to an output of the second constant voltage circuit; and a third MOS transistor which is an nMOS transistor connected between the output terminal and a power supply and having a gate connected to an output of the first constant voltage circuit;

wherein the first constant voltage is set at or below a sum of a threshold voltage of the third MOS transistor and a target voltage which is a target value of the output voltage, and the second constant voltage is set higher than the sum of the target voltage and a threshold voltage of the second MOS transistor.

8. The power supply circuit according to claim 7, wherein the first constant voltage circuit comprises:

a first constant voltage MOS transistor connected between the power supply and the gate of the third MOS transistor;

a second constant voltage MOS transistor which has one end connected to the gate of the third MOS transistor and is diode-connected;

a first constant voltage dividing circuit connected between an other end of the second constant voltage MOS transistor and the ground to output a first divided voltage determined by a predetermined voltage dividing ratio; and a first constant voltage differential amplifier circuit which is fed with a first reference voltage and the first divided voltage and has an output connected to a gate of the first constant voltage MOS transistor, and the second constant voltage circuit comprises:

a third constant voltage MOS transistor connected between the ground and the gate of the second MOS transistor;

a fourth constant voltage MOS transistor which has one end connected to the gate of the second MOS transistor and is diode-connected;

a second constant voltage dividing circuit connected between an other end of the fourth constant voltage MOS transistor and the power supply to output a second divided voltage determined by a predetermined voltage dividing ratio; and a second constant voltage differential amplifier circuit which is fed with a second reference voltage and the second divided voltage and has an output connected to a gate of the third constant voltage MOS transistor.

9. The power supply circuit according to claim 8, wherein the second constant voltage MOS transistor has a threshold voltage set at the threshold voltage of the third MOS transistor, and the fourth constant voltage MOS transistor has a threshold voltage set at the threshold voltage of the second MOS transistor.

10. A power supply circuit that outputs a voltage stepped down from a power supply voltage, comprising:

an output terminal that outputs the output voltage stepped down from the power supply voltage;

a constant voltage circuit that outputs a constant voltage;

a first MOS transistor having one end connected to ground and a gate fed with a fixed voltage;

a second MOS transistor which is a pMOS transistor connected between an other end of the first MOS transistor and the output terminal;

a third MOS transistor which is an nMOS transistor connected between the output terminal and a power supply and having a gate connected to an output of the constant voltage circuit;

a fourth MOS transistor having one end connected to the ground and a gate fed with the fixed voltage;

a fifth MOS transistor which is a diode-connected pMOS transistor having one end connected to an other end of the fourth MOS transistor and a gate of the second MOS transistor; and a sixth MOS transistor which is a diode-connected nMOS transistor connected between an other end of the fifth MOS transistor and the output of the constant voltage circuit, wherein the fifth MOS transistor has a threshold voltage set at or above a threshold voltage of the second MOS transistor, and the sixth MOS transistor has a threshold voltage set at or below a threshold voltage of the third MOS transistor.

11. The power supply circuit according to claim 10, wherein the constant voltage circuit comprises:

a first constant voltage MOS transistor connected between the power supply and the gate of the third MOS transistor;

a second constant voltage MOS transistor which has one end connected to the gate of the third MOS transistor and is diode-connected;

a constant voltage dividing circuit connected between an other end of the second constant voltage MOS transistor and the ground to output a divided voltage determined by a predetermined voltage dividing ratio; and a constant voltage differential amplifier circuit which is fed with a reference voltage and the divided voltage and has an output connected to a gate of the first constant voltage MOS transistor.

12. The power supply circuit according to claim 10, wherein the fifth MOS transistor and the sixth MOS transistor are smaller in size than the third MOS transistor.

13. The power supply circuit according to claim 11, wherein the fifth MOS transistor and the sixth MOS transistor are smaller in size than the third MOS transistor.

14. The power supply circuit according to claim 11, wherein the second constant voltage MOS transistor has a threshold voltage set at the threshold voltage of the third MOS transistor.

15. The power supply circuit according to claim 12, wherein the second constant voltage MOS transistor has a threshold voltage set at the threshold voltage of the third MOS transistor.

* * * * *